US007326068B2

(12) United States Patent
Sturm et al.

(10) Patent No.: US 7,326,068 B2
(45) Date of Patent: Feb. 5, 2008

(54) ELASTOMERIC CONNECTOR AND RETENTION MEMBER FOR HOLDING THE SAME

(75) Inventors: Hans B. Sturm, Upper Black Eddy, PA (US); Curtis G. Knaub, Douglas, MA (US); Vishwa N. Shukla, North Attleboro, MA (US); Edward J. Pupkiewicz, Lansdale, PA (US)

(73) Assignee: Tyco Electronics Corporation, Middletown, PA (US)

( * ) Notice: Subject to any disclaimer, the term of this patent is extended or adjusted under 35 U.S.C. 154(b) by 182 days.

(21) Appl. No.: 11/189,481

(22) Filed: Jul. 26, 2005

(65) Prior Publication Data

US 2007/0026718 A1 Feb. 1, 2007

(51) Int. Cl.
*H01R 4/58* (2006.01)

(52) U.S. Cl. ..... 439/86; 439/91

(58) Field of Classification Search ..... 439/86, 439/91

See application file for complete search history.

(56) References Cited

U.S. PATENT DOCUMENTS 4,027,936 A * 6/1977 Nemoto et al. ..... 439/91
4,109,378 A * 8/1978 Davies ..... 29/876
4,118,092 A * 10/1978 Sado et al. ..... 439/91
4,421,370 A * 12/1983 Treakle et al. ..... 439/91
4,449,774 A * 5/1984 Takashi et al. ..... 439/590
4,643,498 A * 2/1987 Taniguchi ..... 439/68
4,850,883 A * 7/1989 Kabadi ..... 439/67
5,142,449 A * 8/1992 Littlebury et al. ..... 361/782
5,340,318 A * 8/1994 Kunihiro ..... 439/66
5,599,193 A * 2/1997 Crotzer ..... 439/66
5,745,346 A * 4/1998 Ogawa et al. ..... 361/769
6,227,901 B1 5/2001 Pupkiewicz et al.
6,752,639 B1 6/2004 Kirkman et al.

* cited by examiner

*Primary Examiner*—Tho D. Ta

(57) ABSTRACT

A connector assembly includes a first elastomeric connector having a plurality of alternating elastomeric conductors and elastomer insulators. The first elastomeric connector has first and second contact interfaces spaced apart from one another and extending generally perpendicular to the conductors and insulators. The connector assembly also includes a second elastomeric connector having a plurality of alternating elastomeric conductors and elastomer insulators. The second elastomeric connector has first and second contact interfaces spaced apart from one another and extending generally perpendicular to the conductors and insulators. A holder includes a body extending between first and second opposing surfaces, and the body defines a first recess housing the first elastomeric connector and a second recess housing the second elastomeric connector.

17 Claims, 4 Drawing Sheets

ELASTOMERIC CONNECTOR AND RETENTION MEMBER FOR HOLDING THE SAME

BACKGROUND OF THE INVENTION

This invention relates generally to electrical connectors and more specifically, to elastomeric connectors suitable for interconnecting circuit boards and electrical devices, and a retention member for holding elastomeric connectors.

An increasing complexity of electronic assemblies in smaller packages are generating a need for new connectors to interconnect electronic components. For example, liquid crystal displays, vibratory motors, speakers and microphones are now being employed in devices of smaller and smaller size, such as cellular phone products and hand held devices. As the components become smaller and the terminals to connect the components are located closer together, known connectors are proving incapable of establishing reliable electrical connections.

The use of elastomeric connectors has become increasingly popular in some electronic devices because the connectors are readily adaptable in size and geometry to meet a large variety of applications. One type of elastomeric connector typically includes alternating layers of dielectric elastomer, such as silicon rubber, and an elastomer filled or doped with electrically conductive material such as silver particles, graphite particles, conductive fabrics, wires, etc. The dielectric elastomer layers are sandwiched between the conductive layers and are of sufficient thickness to insulate the conductive layers from one another and therefore prevent the formation of electrically conductive or leakage pathways between the conductive layers. The alternating dielectric and conductive layers provide a connector having a large number of conductive pathways in a small volume for closer contact spacing.

Elastomeric connectors are typically used for board-to-board, flex circuit-to-board, and component-to-board applications in mobile communications, portable electronic entertainment systems, hand held instrumentation and other space constrained electronic products. The elastomeric connectors are typically positioned within a dedicated cavity of the electronic product such that the elastomeric connectors have a surface-to-surface compression connection with the various components and/or boards. However, handling the elastomeric connectors as a separate component during assembly causes issues in manufacturability and ease of assembly, thus leading to increased assembly costs.

One approach that has been developed to ease assembly includes the use of a supporting boot that may be molded from an elastomeric material, such as silicone rubber, and formed around the elastomeric connector. Other approaches use a separately provided supporting boot fabricated from an elastomeric material, such as silicone rubber, that may be assembled with the elastomeric connector prior to mounting the boot/connector assembly into the intended electronic product. However, such supporting boots increase the number of components in the electronic product, increase the assembly time and the assembly cost for the electronic product, and increase the overall size of the electronic component.

BRIEF DESCRIPTION OF THE INVENTION

In one aspect, a connector assembly is provided including an elastomeric connector and a non-elastomeric holder configured to receive and maintain the elastomeric connector therein.

Multiple elastomeric connectors may be mounted to the non-elastomeric holder. Optionally, the holder includes a body extending between first and second opposing surfaces, and the body defines a recess configured to receive the elastomeric connector therein. In one embodiment, the body surrounds the recess. In another embodiment, the recess is exposed to an exterior portion of the body. Optionally, the holder may include at least one dispensing well opening to and communicating with the recess, wherein the well is configured to receive a binding agent therein for retaining the elastomeric connector within the recess. The dispensing wells may include angled side walls to define a retaining feature for the binding agent. In one embodiment, the body may define a first recess and a second recess, and the dispensing well may extend between and open to each of the first and second recesses. Optionally, the first recess may extend in a first arcuate path, and the second recess may extend in a second arcuate path that is positioned radially inward with respect to the first recess.

In another aspect, a retention member is provided for supporting an elastomeric connector having a first contact interface, a second contact interface. The retention member includes a non-elastomeric body extending between first and second opposing surfaces, and a recess having a side wall extending between the first and second surfaces. The recess is configured to receive the elastomeric connector therein such that the first and second contact interfaces of the elastomeric connector are exposed on each of the first and second surfaces of the body. A dispensing well extends from the first surface along the side wall of the recess. The dispensing well opens to the recess and includes a retaining feature. The well is configured to receive a binding agent configured to bond to each of the non-elastomeric body and the elastomeric connector for retaining the elastomeric connector within the recess.

In a further aspect, a connector assembly is provided including a first elastomeric connector having a plurality of alternating elastomeric conductors and elastomer insulators. The first elastomeric connector has first and second contact interfaces spaced apart from one another and extending generally perpendicular to the conductors and insulators. The connector assembly also includes a second elastomeric connector having a plurality of alternating elastomeric conductors and elastomer insulators. The second elastomeric connector has first and second contact interfaces spaced apart from one another and extending generally perpendicular to the conductors and insulators. A holder includes a body extending between first and second opposing surfaces, and the body defines a first recess housing the first elastomeric connector and a second recess housing the second elastomeric connector.

DETAILED DESCRIPTION OF THE INVENTION

Figure 1A:
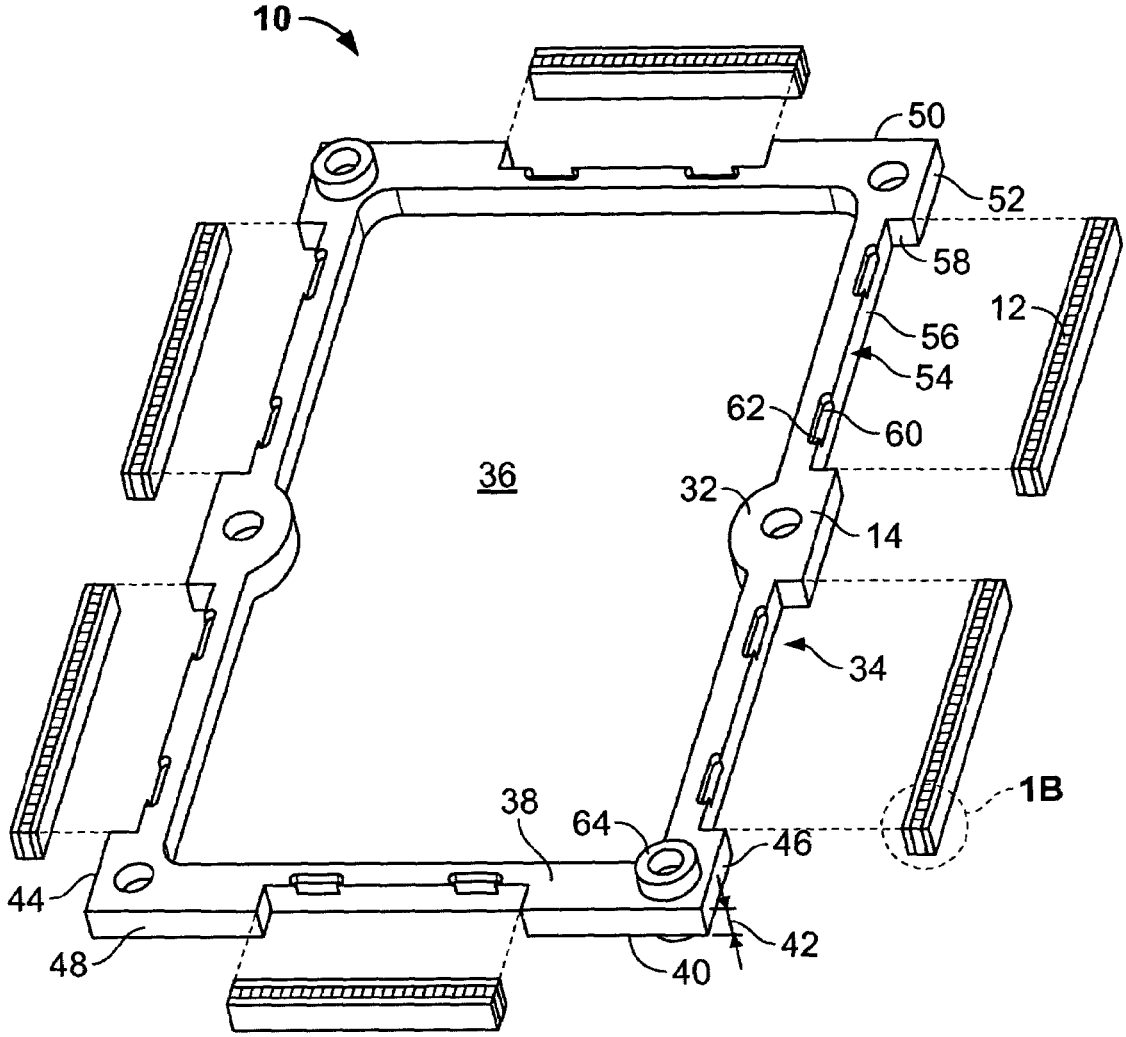
FIG. 1A is an exploded perspective view of an exemplary elastomeric connector assembly including multiple elastomeric connectors and a holder for the elastomeric connectors in accordance with the present invention.
Figure 1B:
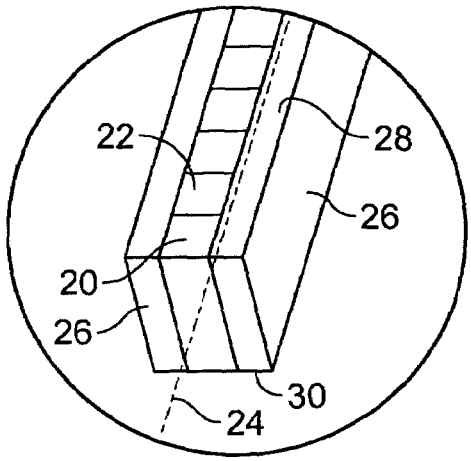
FIG. 1B is an enlarged view of a portion of the elastomeric connector shown in FIG. 1.
Figure 2:
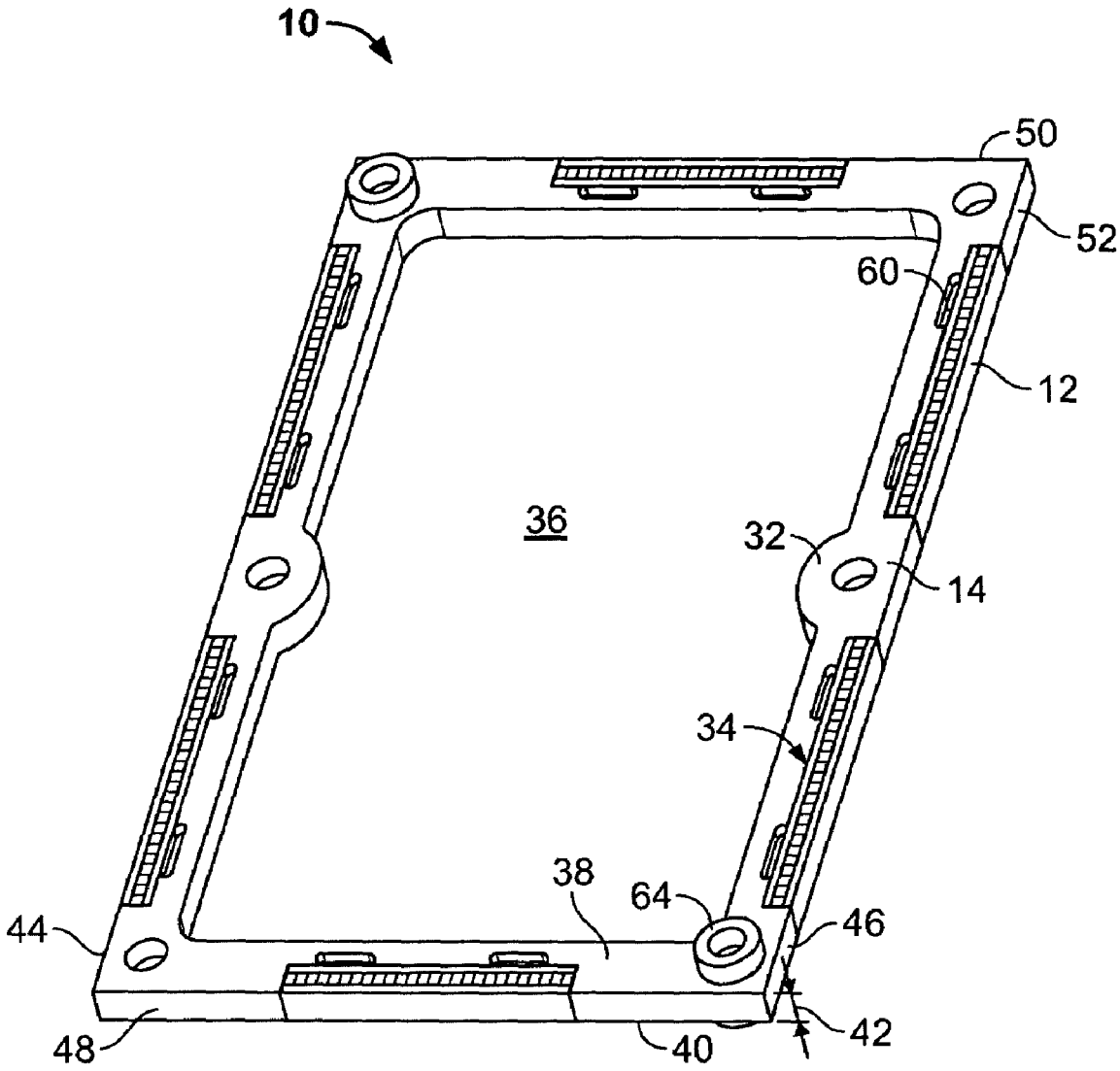
FIG. 2 is a top perspective view of the elastomeric connector assembly shown in FIG. 1 and depicting the elastomeric connectors installed within the holder.

FIG. 1A is an exploded perspective view of an exemplary elastomeric connector assembly 10 including multiple elastomeric elements or connectors 12 and a retention member or holder 14 for the elastomeric connectors 12. FIG. 1B is an enlarged view of the elastomeric connector 12. FIG. 2 is a top perspective view of the elastomeric connector assembly 10 shown in FIG. 1 and depicting the elastomeric connectors 12 installed within the holder 14. The connector assembly 10 may be utilized in an electronic product or device (not shown) having an application such as, for example, mobile communications, portable electronic entertainment, hand held instrumentation or another space constrained electronic application. More specifically, the connector assembly 10 may be utilized for board-to-board, flex circuit-to-board, or component-to-board applications within the electronic products or devices. Additionally, the connector assembly 10 may accommodate different connection geometries or connection patterns within the circuit board, flex circuit, or other electronic components such as polar, co-planar, arrayed or multi-level geometries or patterns.

The elastomeric connectors 12 include alternating non-conductive layers 20 and conductive layers 22. The non-conductive layers 20 are fabricated from a dielectric or insulating material, such as silicone rubber, and the conductive layers 22 are fabricated from a material such as a known particle filled silicone elastomer. The non-conductive layers 20 and the conductive layers 22 extend substantially perpendicular to a longitudinal axis 24 of the connector 12, in a face-to-face relationship to one another in a continuous strip. The alternating non-conductive and conductive layers 20 and 22 of the elastomeric connector 12 provide a large number of conductive pathways through the elastomeric connector 12 in a relatively small volume, and the non-conductive layers 20 prevent current flow from one conductive layer 22 to another within the elastomeric connector 12.

In the illustrated embodiment, the connector 12 is of a generally rectangular shape and includes a pair of outer insulation elements 26 with the non-conductive and conductive layers 20 and 22 therebetween. The elastomeric connector 12 includes opposed top and bottom surfaces 28 and 30 extending between the upper and lower edges of the outer insulation elements 26. Each of the top and bottom surfaces 28 and 30 interface with, for example, a surface of a circuit board, a flex circuit, or another electronic component (not shown) associated with the electronic product. The conductive layers 22 in the elastomeric connector 12 therefore establish a plurality of conductive paths between each of the components, circuits, or circuit boards interfacing with the top and bottom surfaces 28 and 30 of the connector 12.

The holder 14 is provided to secure the multiple connectors 12 in a position or orientation to interface with the various components, circuits, or circuit boards when the electronic product is assembled. The holder 14 includes a frame or body 32 having a plurality of notches or recesses 34 for receiving the elastomeric connectors 12. In the illustrated embodiment, the body 32 is generally rectangular in shape and includes an opening 36 within the interior portion of the holder 14. The opening 36 provides a reduced product cost and weight, and provides an area to position other components of the electronic product. In an exemplary embodiment, the body 32 of the holder 14 is fabricated from a rigid or semi-rigid material such as, for example, a metal material, a polypropylene material, a polycarbonate material, a polyethylene material, a liquid crystalline plastic material, a polyamide material, a polyetherimide material, or the like. As such, a liquid binding agent used to secure the elastomeric connector 12 to the holder 14, as will be described in detail below, is selected to facilitate bonding to each of the silicone rubber material of the elastomeric connector 12 and the metal or plastic material of the holder 14. Optionally, the binding agent may be an adhesive. Alternatively, another binding agent may be used.

The body 32 includes a first or upper surface 38 and a second or lower surface 40. The first and second surfaces 38 and 40 are generally planar and are separated from one another by a distance 42. The body 32 also includes first and second opposed longitudinal side walls 44 and 46, and first and second opposed lateral side walls 48 and 50. An outer edge 52 extends between each of the first and second surfaces 38 and 40 along the longitudinal and lateral side walls 44, 46, 48, and 50. Moreover, the recesses 34 extend inwardly from the outer edge 52 of the body 32 and extend entirely between the first and second surfaces 38 and 40. In an exemplary embodiment, the holder 14 includes recesses 34 in each of the side walls 44, 46, 48, and 50 of the body 32. In an illustrative embodiment, the holder 14 includes one recess 34 in each of the lateral side walls 48 and 50, and two recesses 34 in each of the longitudinal side walls 44 and 46. However, more or less recesses 34 may be included in each of the side walls 44, 46, 48, and 50. In an exemplary embodiment, the recesses 34 are exposed to the exterior of the holder 14.

The recesses 34 are defined by a side wall 54 extending between the first and second surfaces 38 and 40. In an exemplary embodiment, the recesses 34 are substantially rectangular, and the side wall 54 includes a longitudinal portion 56 and opposed lateral portions 58. The lateral portions 58 extend perpendicular with respect to the adjacent outer edge 52 of the body 32, and the longitudinal portion 56 extends perpendicular to the lateral portion 58. As such, boxed out or notched out portions define the recesses 34 along the outer edge 52 of the body 32. When assembled, as illustrated in FIG. 2, the elastomeric connectors 12 are positioned within the notched out recesses 34 and engage the side walls 54 of the recesses 34.

The holder 14 includes dispensing wells 60 positioned adjacent to each recess 34. In the illustrated embodiment, two dispensing wells 60 are associated with each recess 34. Each dispensing well 60 opens to the first or upper surface 38 of the body 32 such that the liquid binding agent may be delivered to the dispensing well 60. Optionally, dispensing wells 60 may be provided on both the upper and lower surfaces 38 and 40. Each dispensing well 60 opens to the adjacent recess 34 such that the liquid binding agent may bond to the elastomeric connector 12 within the recess 34. As such, the binding agent is selected to facilitate creating a chemical bond with each of the holder and the elastomeric connector 12. In an exemplary embodiment, the dispensing wells 60 are oriented along the longitudinal portion 56 of the recess side wall 54. As such, the liquid binding agent is attached to a single insulation element 26 of each elastomeric connector 12.

In an exemplary embodiment, each dispensing well 60 includes a keystone or keying feature 62 to retain and secure the binding agent within the dispensing well 60. As such, the retaining feature 62 provides additional retention properties for the elastomeric connectors 12 in addition to the chemical bond between the holder 14 and the binding agent. In one embodiment, the walls of the dispensing well 60 may be angled outward from the opening to the recess 34 to define the retaining features 62. As such, once the binding agent cures, or is otherwise bonded to each of the elastomeric connector 12 and the holder 14, the binding agent resists movement of the elastomeric connector 12 away from the body 32 during handling or assembly of the electronic product. Optionally, the retaining feature 62 may include a rib or flange (not shown) extending from the body 32 into the dispensing well 60 such that the binding agent at least partially surrounds the rib or flange to provide resistance to movement of the elastomeric connector 12.

The holder 14 may be provided with mounting holes, recesses or alignment pins 64 for accurately positioning the assembly 10 in a final mounting position within the electronic product or device. Moreover, it will be recognized that the shape of the holder 14 may be varied to accommodate mounting requirements in different applications. As such, the elastomeric connector assembly 10 is capable of surface mounting a plurality of elastomeric connectors 12 as a single assembly, thus reducing assembly time and cost.

Figure 3:
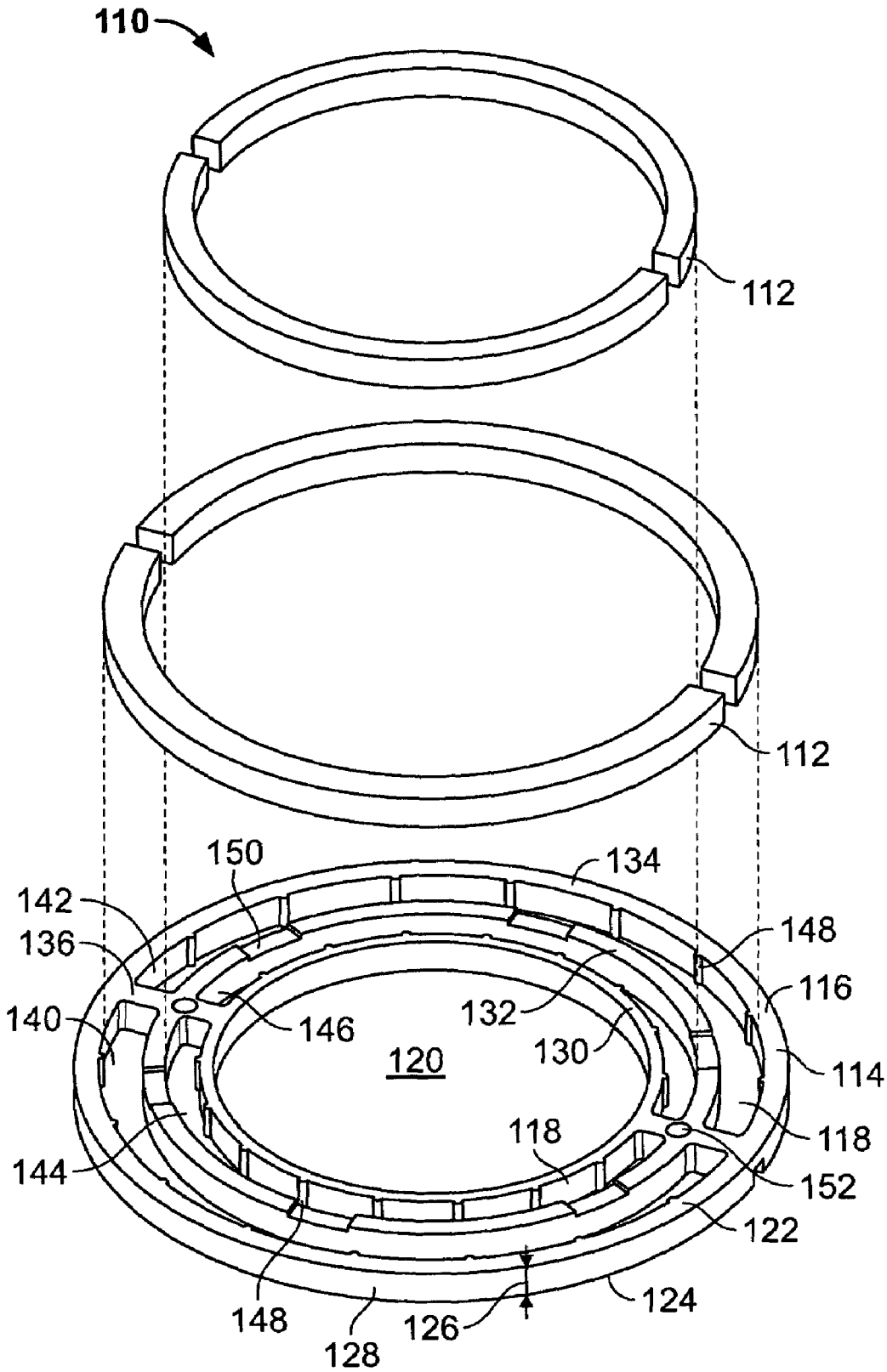
FIG. 3 is an exploded perspective view of another exemplary elastomeric connector assembly including multiple elastomeric connectors and a holder for the elastomeric connectors in accordance with an alternative embodiment of the present invention.
Figure 4:
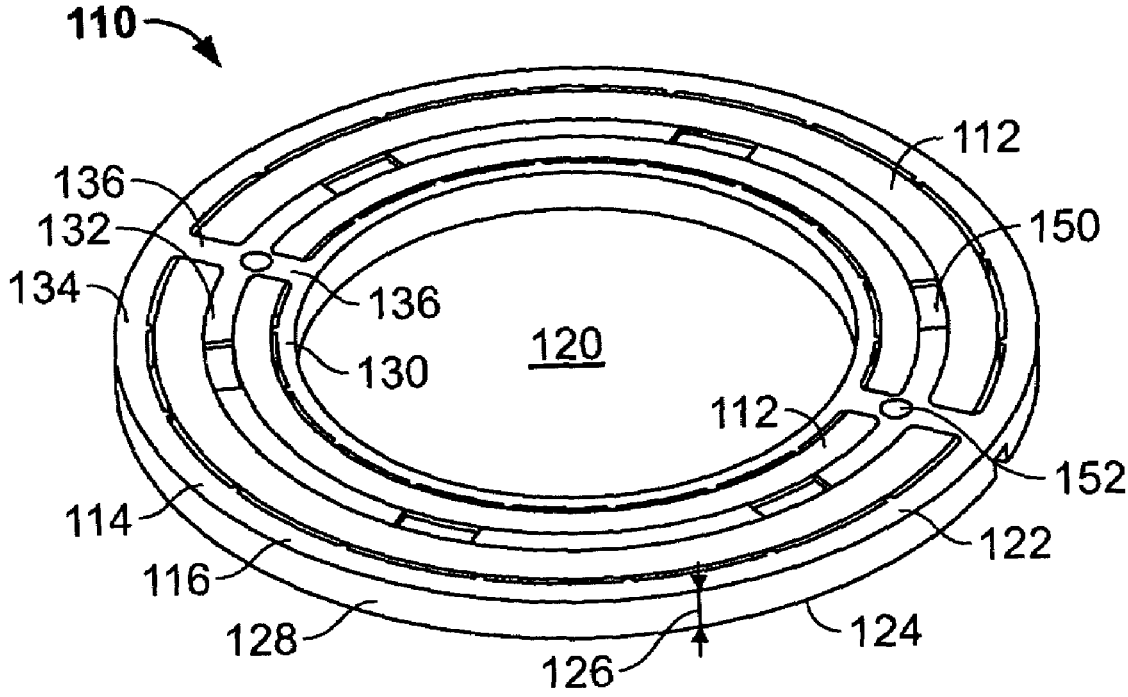
FIG. 4 is a top perspective view of the elastomeric connector assembly shown in FIG. 3 and depicting the elastomeric connectors installed within the holder.

FIG. 3 is an exploded perspective view of an alternative elastomeric connector assembly 110 including multiple elastomeric connectors 112 and a holder 114 for the elastomeric connectors 112 in accordance with an alternative embodiment of the present invention. FIG. 4 is a top perspective view of the elastomeric connector assembly 110 shown in FIG. 3 and depicting the elastomeric connectors 112 installed within the holder 114. As with the connector assembly 10, the connector assembly 110 may be utilized in an electronic product or device (not shown) having a space constrained electronic application.

The elastomeric connectors 112 are fabricated in a similar manner as the elastomeric connectors 12 described above with reference to FIGS. 1 and 2. However, the elastomeric connectors 112 have a generally arcuate or curved shape. Specifically, each elastomeric connector 112 is substantially semi-circular in an exemplary embodiment.

The holder 114 is provided to secure the multiple connectors 112 in a position or orientation to interface with the various components, circuits, or circuit boards when the electronic product is assembled. The holder 114 includes a frame or body 116 having a plurality of openings or recesses 118 for receiving the elastomeric connectors 112. In an illustrative embodiment, the body 116 is generally circular in shape and includes an opening 120 within the interior portion of the holder 114. In an exemplary embodiment, the body 116 of the holder 114 is fabricated from a rigid or semi-rigid material such as, for example, a polypropylene material, a polycarbonate material, a polyethylene material, a liquid crystalline plastic material, a polyamide material, a polyetherimide material, or the like.

The body 116 includes a first or upper surface 122 and a second or lower surface 124. The first and second surfaces 122 and 124 are generally planar and are separated from one another by a distance 126. An outer edge 128 defines the perimeter of the body 116 and extends between each of the first and second surfaces 122 and 124. The holder 114 includes a radially extending inner ring 130, a middle ring 132, and a radially extending outer ring 134. The opening 120 is defined by an interior portion of the radially extending inner ring 130, and the outer edge 128 of the body 116 defines an exterior portion of the radially outer ring 134. The radially extending inner and outer rings 130 and 134 are joined to the middle ring 132 by a joining wall 136. In the illustrated embodiment, the joining walls 136 are substantially aligned with one another. Alternatively, the joining walls 136 may be offset with respect to one another. Additionally, the holder 114 may include more or less than two joining walls 136 between each of the rings 130, 132, and 134.

The recesses 118 are defined by each of the rings 132, 134, and 136. In an exemplary embodiment, the holder 114 includes first and second radially extending outer recesses 140 and 142, respectively, and first and second radially extending inner recesses 144 and 146. The radially extending outer recesses 140 and 142 extend between the radially extending outer ring 134 and the middle ring 132. Additionally, the radially extending outer recesses 140 and 142 are separated from one another by the joining walls 136 extending between the outer ring 134 and the middle ring 132. Moreover, the radially extending inner recesses 144 and 146 extend between the radially extending inner ring 130 and the middle ring 132, and the radially extending inner recesses 144 and 146 are separated from one another by the joining walls 136 extending between the inner ring 130 and the middle ring 132. However, more or less recesses 118 may be included in the holder 114. When assembled, and as illustrated in FIG. 4, the elastomeric connectors 112 are positioned within the recesses 118 and engage the side walls of the recesses 118. Optionally, the recesses 118 may include ribs or flanges 148 extending from the side walls of the recesses 118. The ribs or flanges 148 are sized and position the elastomeric connectors 112 within the recesses 118.

The holder 114 includes dispensing wells 150 positioned adjacent to each recess 118. In an exemplary embodiment, each dispensing well 150 is in fluid communication with multiple recesses 118. Optionally, each dispensing well 150 may communicate with a radially inner recess 144 or 146 and a radially outer recess 140 or 142. Additionally, more than one dispensing well 150 may extend between each recess 118. Each dispensing well 150 opens to the first or upper surface 122 of the body 116 such that a liquid binding agent may be delivered to the dispensing well 150. Each dispensing well 150 also opens to the adjacent recesses 140 or 142 and 144 or 146 such that the liquid binding agent in each dispensing well 150 may bond to an inner and an outer elastomeric connector 112.

In an exemplary embodiment, each elastomeric connector 112 may function as a retaining or keying feature to secure the binding agent within the dispensing well 150. Specifically, the inner elastomeric connector 112 functions as a retaining feature for the adjacent outer elastomeric connector 112 to resist movement of the outer elastomeric connector 112 away from the body 116 during handling or assembly of the electronic product. Similarly, the outer elastomeric connector 112 functions as a retaining feature for the adjacent inner elastomeric connector 112 to resist movement of the inner elastomeric connector 112. Optionally, each dispensing well 150 may include a rib or flange (not shown) extending from the body 116 into the dispensing well 150 such that the binding agent at least partially surrounds the rib or flange to provide resistance to movement of the elastomeric connectors 112.

The holder 114 may be provided with mounting holes, recesses or alignment pins 152 for accurately positioning the assembly 110 in a final mounting position within the electronic product or device. Moreover, it will be recognized that the shape of the holder 114 may be varied to accommodate mounting requirements in different applications.

An elastomeric connector assembly 10 or 110 is thus provided having multiple elastomeric connectors 12 or 112 mounted thereto. The connectors 12 or 112 are grafted or bonded within recesses 34 or 118 in the holder 14 or 114. To increase the robustness of the assembly 10 or 110, the holders 14 or 114 include retaining features to reduce the stress on the chemical bond between the binding agent and the holder 14 or 114. As a result, the elastomeric connector assembly 10 or 110 is capable of surface mounting a plurality of elastomeric connectors 12 or 112 as a single assembly, thus reducing assembly time and cost.

While the invention has been described in terms of various specific embodiments, those skilled in the art will recognize that the invention can be practiced with modification within the spirit and scope of the claims.

What is claimed is:

1. A connector assembly comprising:

an elastomeric connector; and a non-elastomeric holder configured to receive and maintain said elastomeric connector therein, wherein said holder comprises a body defining a recess configured to receive said elastomeric connector therein, said holder includes at least one dispensing well opening to and communicating with said recess, and said dispensing well is configured to receive a binding agent therein for retaining said elastomeric connector within said recess.

2. The connector assembly of claim 1, wherein each said dispensing well includes angled side walls to define a retaining feature for the binding agent which provides a mechanical retention for the elastomeric connector in addition to the binding agent.

3. The connector assembly of claim 1, wherein said body defines a first recess and a second recess, said dispensing well extending between and opening to each of said first and second recesses.

4. The connector assembly of claim 1, further comprising multiple elastomeric connectors mounted to said non-elastomeric holder.

5. The connector assembly of claim 1, wherein said body surrounds said recess.

6. The connector assembly of claim 1, wherein said recess is exposed to an exterior portion of said body.

7. The connector assembly of claim 1, wherein said holder comprises a first recess and a second recess, said first recess extending in a first arcuate path, said second recess extending in a second arcuate path and positioned radially inward with respect to said first recess.

8. A retention member for supporting an elastomeric connector having a first contact interface and a second contact interface, said retention member comprising:

a non-elastomeric body extending between first and second opposing surfaces;

a recess comprising a side wall extending between said first and second surfaces, said recess configured to receive the elastorneric connector therein, such that the first and second contact interfaces of the elastomeric connector are exposed on each of said first and second surfaces of said body; and a dispensing well extending from said first surface along said side wall of said recess, said dispensing well opening to said recess and comprising a retaining feature, said well configured to receive a binding agent configured to bond to each of said non-elastomeric body and the elastomeric connector for retaining the elastomeric connector within said recess.

9. The retention member of claim 8, wherein said recess is surrounded by said side wall.

10. The retention member of claim 8, wherein said recess is exposed to an exterior portion of said body.

11. The retention member of claim 8, wherein each said dispensing well includes angled side walls to define said retaining feature.

12. The retention member of claim 8, wherein said body defines a first recess and a second recess, said well extending between and opening to each of said first and second recesses.

13. The retention member of claim 8, wherein said body defines a first recess and a second recess, said first recess extending in a first arcuate path, said second recess extending in a second arcuate path and positioned radially inward with respect to said first recess.

14. A connector assembly comprising:

a first elastomeric connector comprising a plurality of alternating elastomeric conductors and elastomer insulators having first and second contact interfaces spaced apart from one another and extending generally perpendicular to the conductors and the insulators;

a second elastomeric connector comprising a plurality of alternating elastomeric conductors and elastomer insulators having first and second contact interfaces spaced apart from one another and extending generally perpendicular to the conductors and the insulators; and a holder comprising a body extending between first and second opposing surfaces, said body defining a first recess housing said first elastomeric connector and a second recess housing said second elastomeric connector, wherein said holder comprises at least one dispensing well extending from said first surface, each said dispensing well opening to at least one of said first and second recesses.

15. The connector assembly of claim 14, wherein said holder comprises a non-elastomeric body.

16. The connector assembly of claim 14, wherein each said dispensing well includes angled side walls to define a retaining feature.

17. The connector assembly of claim 14, wherein said first recess extends in a first arcuate path, and said second recess extends in a second arcuate path and is positioned radially inward with respect to said first recess.

* * * * *